US009918902B2

(12) United States Patent
Gobbi Frattini

(10) Patent No.: US 9,918,902 B2
(45) **Date of Patent: *Mar. 20, 2018**

(54) BOTTLE FOR PHARMACOLOGICAL AND/OR NUTRITIONAL ACTIVE SUBSTANCES WITH HERMETIC CLOSURE PIERCEABLE WITH A NEEDLE-FREE SYRINGE AND AUTOMATICALLY RESEALABLE

(71) Applicant: PAOLO GOBBI FRATTINI s.r.l., Milan (IT)

(72) Inventor: Paolo Giuseppe Gobbi Frattini, Sondalo So (IT)

(73) Assignees: DITTA IND. PAOLO GOBBI FRATTINI, Sondalo So (IT); PAOLO GOBBI FRATTINI S.R.L., Milan (IT)

( * ) Notice: Subject to any disclaimer, the term of this patent is extended or adjusted under 35 U.S.C. 154(b) by 306 days.

This patent is subject to a terminal disclaimer.

(21) Appl. No.: 14/407,701

(22) PCT Filed: Jun. 21, 2013

(86) PCT No.: PCT/EP2013/063067

§ 371 (c)(1),
(2) Date: Dec. 12, 2014

(87) PCT Pub. No.: WO2014/001226

PCT Pub. Date: Jan. 3, 2014

(65) Prior Publication Data

US 2015/0164745 A1 Jun. 18, 2015

(30) Foreign Application Priority Data

Jun. 27, 2012 (IT) ..... MI2012A1133

(51) Int. Cl.
*A61J 1/22* (2006.01)
*B65D 51/00* (2006.01)
(Continued)

(52) U.S. Cl.
CPC ..... *A61J 1/22* (2013.01); *A61J 1/1406* (2013.01); *A61J 1/1412* (2013.01);
(Continued)

(58) Field of Classification Search
CPC ..... A61J 1/22; A61J 1/1406; A61J 1/1412; A61J 1/2003; A61J 1/1468; B65D 1/002; B65D 1/20
See application file for complete search history.

(56) References Cited

U.S. PATENT DOCUMENTS 4,954,149 A 9/1990 Fullemann
5,268,771 A 12/1993 Murakami et al.
(Continued)

FOREIGN PATENT DOCUMENTS

WO 95/15194 A1 6/1995
WO 2012/101101 A1 8/2012

*Primary Examiner* — Leslie Deak
(74) *Attorney, Agent, or Firm* — Jacobson Holman, PLLC.

(57) ABSTRACT

A bottle for containing pharmacological and/or nutritional active substances is described. The bottle comprises a closing cap pierceable by the pressure exerted with the luer of a needle-free syringe. The closing cap is made as a single piece including a check valve and closing lips which can be opened by introducing a syringe luer and can be elastically closed back upon the extraction of the luer introduced, and a membrane which is pierceable and elastically resealable to hermetically close the inlet end of the check valve.

22 Claims, 10 Drawing Sheets

(51) Int. Cl.

| | |
|---|---|
| ***B65D 51/20*** | (2006.01) |
| ***A61J 1/14*** | (2006.01) |
| *A61J 1/20* | (2006.01) |

(52) U.S. Cl.
CPC ..... *B65D 51/002* (2013.01); *B65D 51/20* (2013.01); *A61J 1/1468* (2015.05); *A61J 1/2003* (2015.05)

(56) References Cited

U.S. PATENT DOCUMENTS

| | | | | |
|---|---|---|---|---|
| 5,328,041 | A | 7/1994 | Hook et al. | |
| 6,221,056 | B1 | 4/2001 | Silverman | |
| 9,227,048 | B2 * | 1/2016 | Gobbi Frattini .... | A61M 39/045 |
| 2002/0193752 | A1 | 12/2002 | Lynn | |
| 2004/0045924 | A1 * | 3/2004 | Naritomi ..... | A61J 1/1406 215/247 |
| 2008/0093571 | A1 | 4/2008 | Desecki | |

* cited by examiner

BOTTLE FOR PHARMACOLOGICAL AND/OR NUTRITIONAL ACTIVE SUBSTANCES WITH HERMETIC CLOSURE PIERCEABLE WITH A NEEDLE-FREE SYRINGE AND AUTOMATICALLY RESEALABLE

The present invention relates to a bottle for pharmacological and/or nutritional active substances with hermetic closure pierceable with a needle-free syringe and automatically resealable.

Hermetic connectors for flexible bags for containing pharmacological and/or nutritional liquid solutions are known, which are in turn pierceable with the needle of a syringe or even with the needle-free luer of the syringe itself. Hermetic connectors pierceable without needle are known for example from U.S. 2008/093571, WO 95/15194 and U.S. Pat. No. 5,268,771.

The use of bottles or containers in general is also known, containing pharmacological and/or nutritional active substances, in the form of liquid or powder or gel, which are drawn or injected by piercing the closing cap of the bottles themselves with the needle of a syringe. See for example U.S. Pat. No. 6,221,056 B1 and U.S. Pat. No. 4,954,149.

The use of a cannula, as in U.S. Pat. No. 5,328,041, may be contemplated as an alternative to the use of the needle. In this case, the bottle closing cap is made in two pieces, an inner cap made of elastomeric material crossed by an axial slot which forms a check valve against the leak of product from the interior of the bottle, and an outer cap of reduced thickness which can be perforated by the cannula.

Valves for medical use are also known, which are intended for various purposes, in which a single body of elastomeric material consists of a lower part with axial slot adapted to operate as a check valve, and of an upper part consisting of a thin membrane which is pierceable by the luer of a syringe for introducing the luer itself into said slot and automatically resealable upon the subsequent extraction of the luer.

In all cases, the most important requirement is that the bottle is hermetically sealed both before and after the operation of drawing the liquid solution, so as to prevent dangerous contamination of the liquid solution itself.

In view of such a prior art, it is the object of the present invention to provide a bottle provided with a closing device pierceable by the luer of a needle-free syringe, in which the perfect seal of the closure is ensured both before the introduction of the luer and after the extraction of the luer itself at the end of the operation.

In accordance with the invention, the above object is achieved by a bottle for containing pharmacological and/or nutritional active substances as defined in claim 1.

Important advantageous effects are obtained due to the present invention, particularly as regards the safety of the resealing operation after each introduction and extraction of the syringe luer and the elimination of any back flow effect upon the extraction of the luer, which are combined with hermetic sealing before use, low cost and needle absence.

An embodiment of the present invention is shown by way of non-limiting example in the accompanying drawings, in which.

Figure 1:
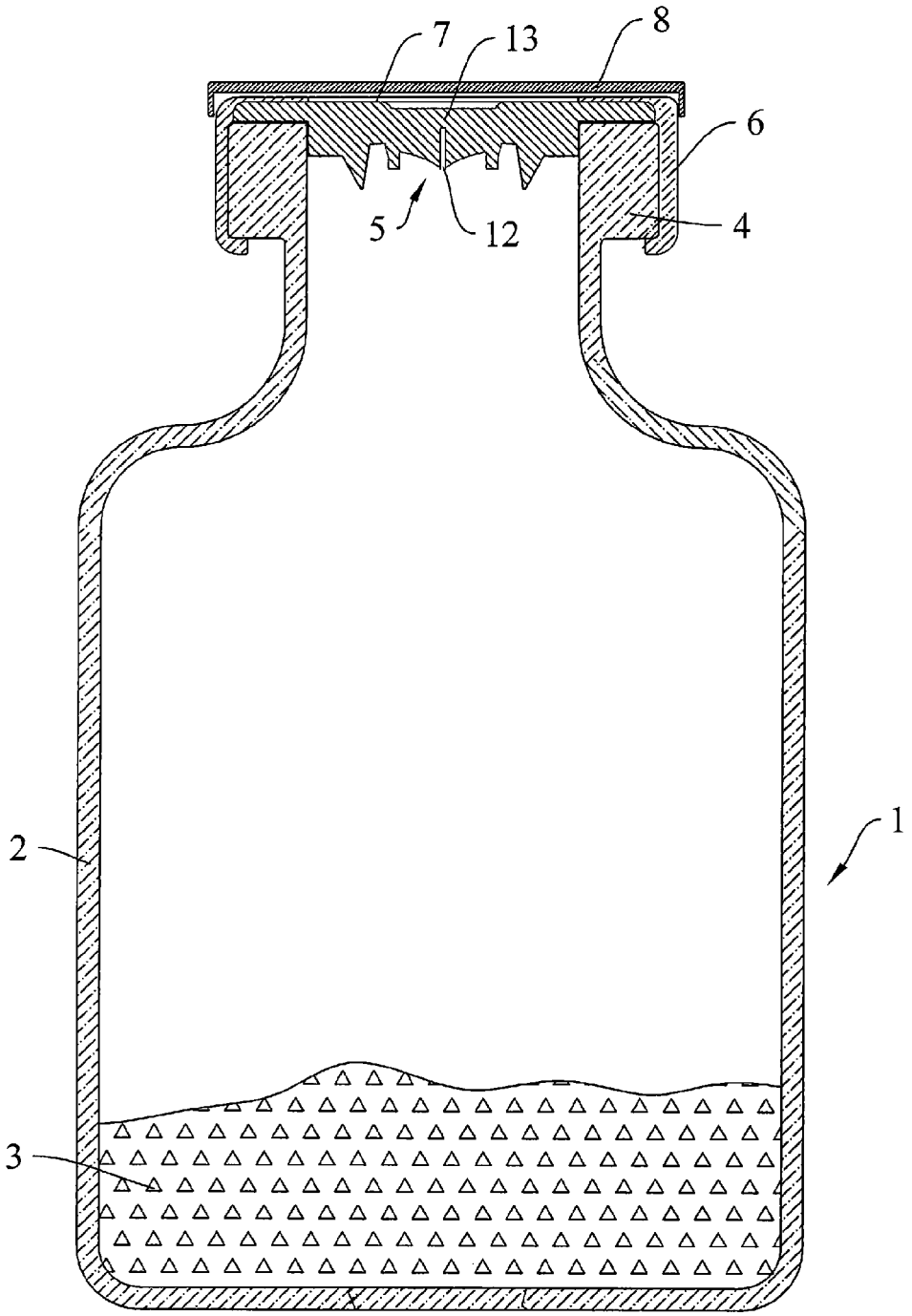
FIG. 1 shows an axial section of a first exemplary bottle according to the invention with hermetic closure and cap pierceable with the luer of a syringe.

The bottle shown in FIGS. 1-4, where it is indicated as a whole with reference numeral 1, comprises a main body 2, which can be made of glass or plastic, in which a pharmacological and/or nutritional active substance 3, mainly drugs in the form of powder, liquid or gel, may be contained.

The upper mouth 4 of the main body 2 is hermetically closed by a closing cap 5 made of an elastically deformable material (preferably a thermoplastic elastomer, for example consisting of a styrene-ethylene-butylene-styrene-based copolymer, or a medical-grade silicone), which is coupled to mouth 4 by means of a metal or plastic collar 6 with a central hole 7. A removable protective cover 8 covers the entire closure area of the bottle.

Figure 2:
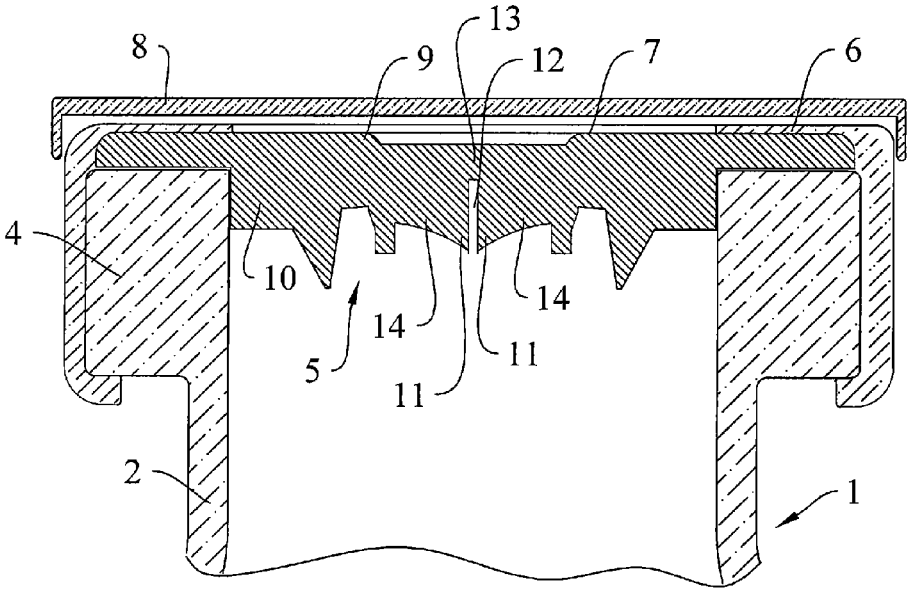
FIG. 2 shows the enlarged detail of the hermetic closure area of the bottle in FIG. 1.
Figure 3:
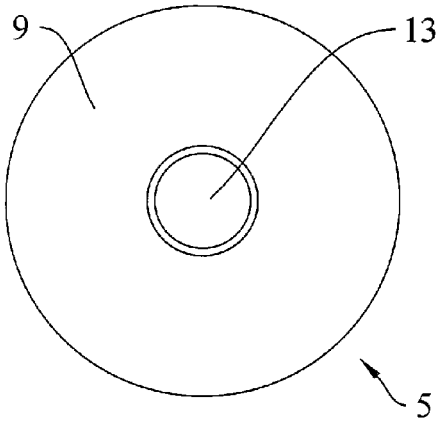
FIG. 3 shows the pierceable closing cap of said bottle seen from the top with respect to FIGS. 1 and 2.
Figure 4:
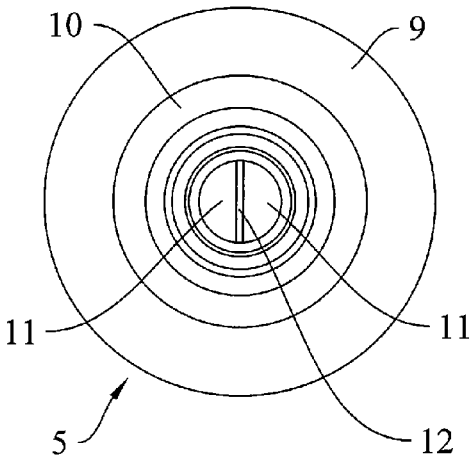
FIG. 4 shows said closing cap seen from the bottom with respect to FIGS. 1 and 2.

As better shown in FIG. 2, the closing cap 5 is formed as a single piece by a substantially flat upper part 9, which laterally rests on the mouth 4 of the bottle body, and a lower part 10 which is sealingly forced into mouth 4.

Said lower part 10 centrally comprises a pair of laterally adjacent lips 11, progressively thinning downwards, between which a check or non-return valve is provided, preferably in the step of molding, consisting of a thin slot 12 with rectangular section which is open at the lower end and ends at the top immediately before a thin hermetic closing membrane 13 (preferably with a thickness of about 0.1 mm) made in a lowered central part of the upper part 9 of cap 5. The two lateral lips 11 include concave outer recesses 14 which laterally extend upwards with increasing depth from the lower end of the lips themselves, starting from slot 12.

It should be noted that the sum of the length of slot 12 and the thickness of membrane 13 is preferably less than or equal to the length of a syringe luer.

Figure 5:
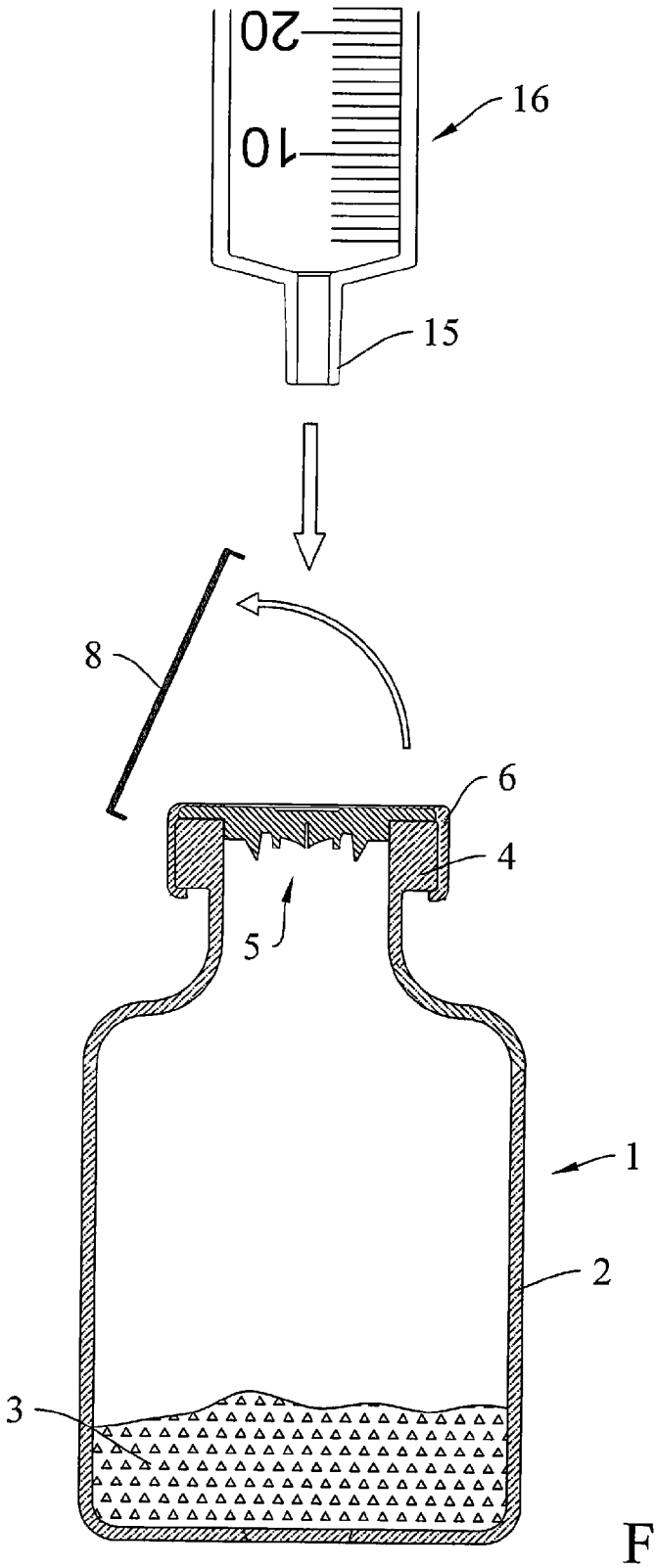
FIG. 5 shows a bottle as shown in FIG. 1 and a syringe with luer immediately before being connected together in order to pierce the closing cap of the bottle.

FIG. 5 shows bottle 1 while the protective cover 8 is being removed for receiving the luer 15 or the connection tang of a needle-free syringe 16.

Figure 6:
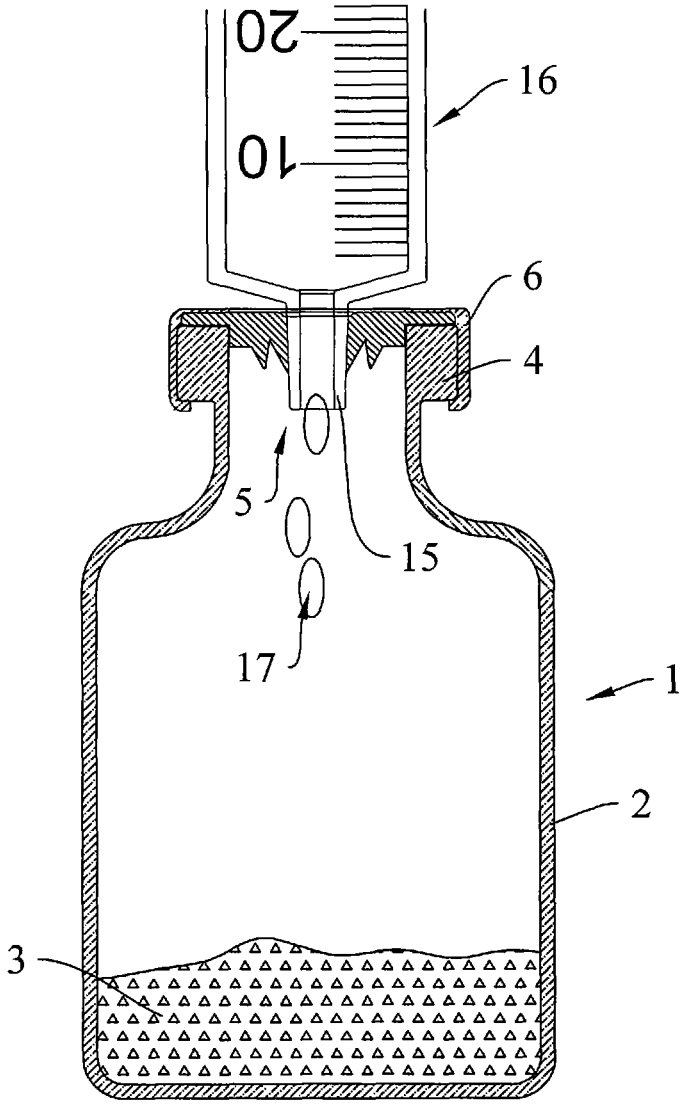
FIG. 6 shows the bottle and the syringe connected together.

The connection is obtained by pressing luer 15 against the top of the closing cap 5. Thereby, luer 15 pierces membrane 13 and is inserted into slot 12, thus moving away the two lateral lips 11 up to reach the interior of the bottle body, as shown in FIG. 6.

Since, as already said, the overall axial height of slot 12 and membrane 13 is preferably less than or equal to the length of a syringe luer, luer 15 thus introduced allows syringe 16 to operate in a bidirectional manner, thus allowing both the introduction of mixing liquid drops 17 for the active substance 3 (FIG. 6) and the drawing of the possibly mixed active substance.

Figure 7:
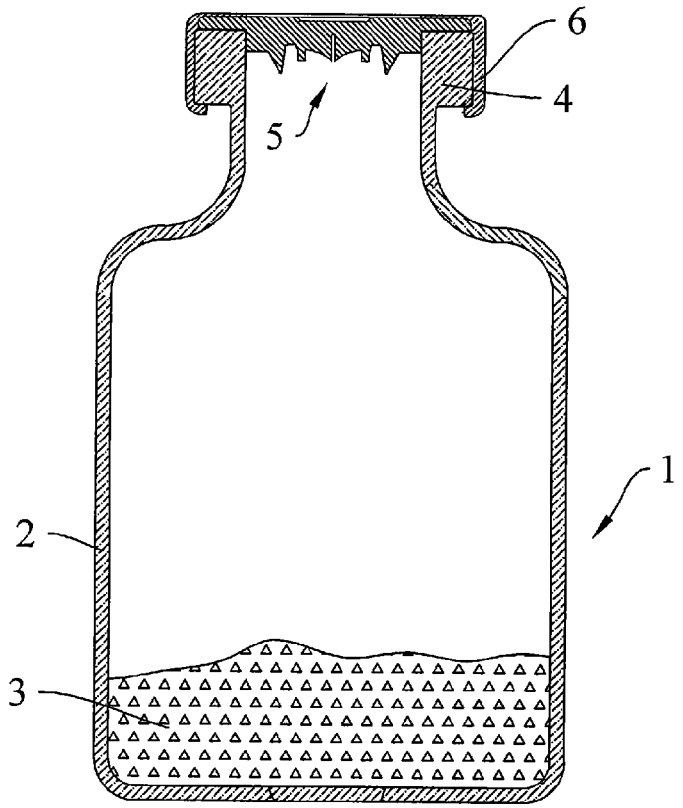
FIG. 7 shows an axial section of the same bottle once the syringe has been disconnected.
Figure 8:
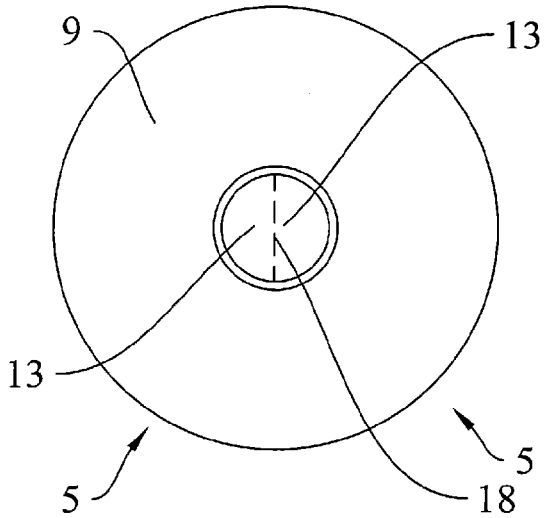
FIG. 8 shows a top plan view of the closing cap of the bottle in FIG. 7.

At the end of the operation, the syringe luer 15 can be extracted from the slot 12 of the closing cap 5, the lateral lips 11 of which are closed again by means of elastic stress, thus reaching the position in FIG. 7, which is identical to the initial position shown in FIG. 1. Membrane 13 is also closed back elastically, thus obtaining the hermetic closure of the bottle again, as shown in FIG. 8, where the dash-and-dot line 18 symbolizes the re-contact and closing point of the membrane.

The concave shape of the outer recesses 14 of the lateral lips 11 facilitates and forces the closing of slot 12 and membrane 13, thus carrying out a function of check valve which prevents the liquid from leaking out from bottle 1 during and after the extraction of the luer.

The bottle shown in FIGS. 9-12 has sealing properties similar to those of the bottle in FIGS. 1-4, with the difference that it includes a closing cap which is pierceable by means of a syringe of the so-called "luer-lock" type, i.e. with a male luer partially surrounded by a coaxial outer sleeve, internally threaded.

In this type of bottle, mouth 4 includes a seal 21 with a central hole 22 which is held in place by a metal or plastic collar 6 which has here a central extension 23 directed upwards, provided with an outer annular groove 24.

Said central extension 23 serves as a support for a closing cap 25 made of an elastically deformable material (preferably a thermoplastic elastomer, for example consisting of a styrene-ethylene-butylene-styrene-based compound, or a medical-grade silicone), which has features similar to those of the closing cap 5 of the bottle in FIGS. 1-4.

More precisely, the closing cap 25 is formed as a single piece by an upper part 26 having annular shape, which laterally rests on the mouth of support 23, and by a lower part 27 which is sealingly forced into said mouth.

Said lower part 27 centrally comprises a pair of laterally adjacent lips 28, progressively thinning downwards, between which a check or non-return valve is provided, preferably in the step of molding, consisting of a thin slot 12 with rectangular section which is open at the lower end and ends at the top immediately before a thin hermetic closing membrane 30 (preferably with a thickness of about 0.1 mm). The two lateral lips 28 include concave outer recesses 31 which laterally extend upwards with increasing depth from the lower end of the lips themselves, starting from slot 29.

Also in this case, it should be noted that the sum of the length of slot 29 and the thickness of membrane 30 is preferably less than or equal to the length of a syringe luer.

Figure 9:
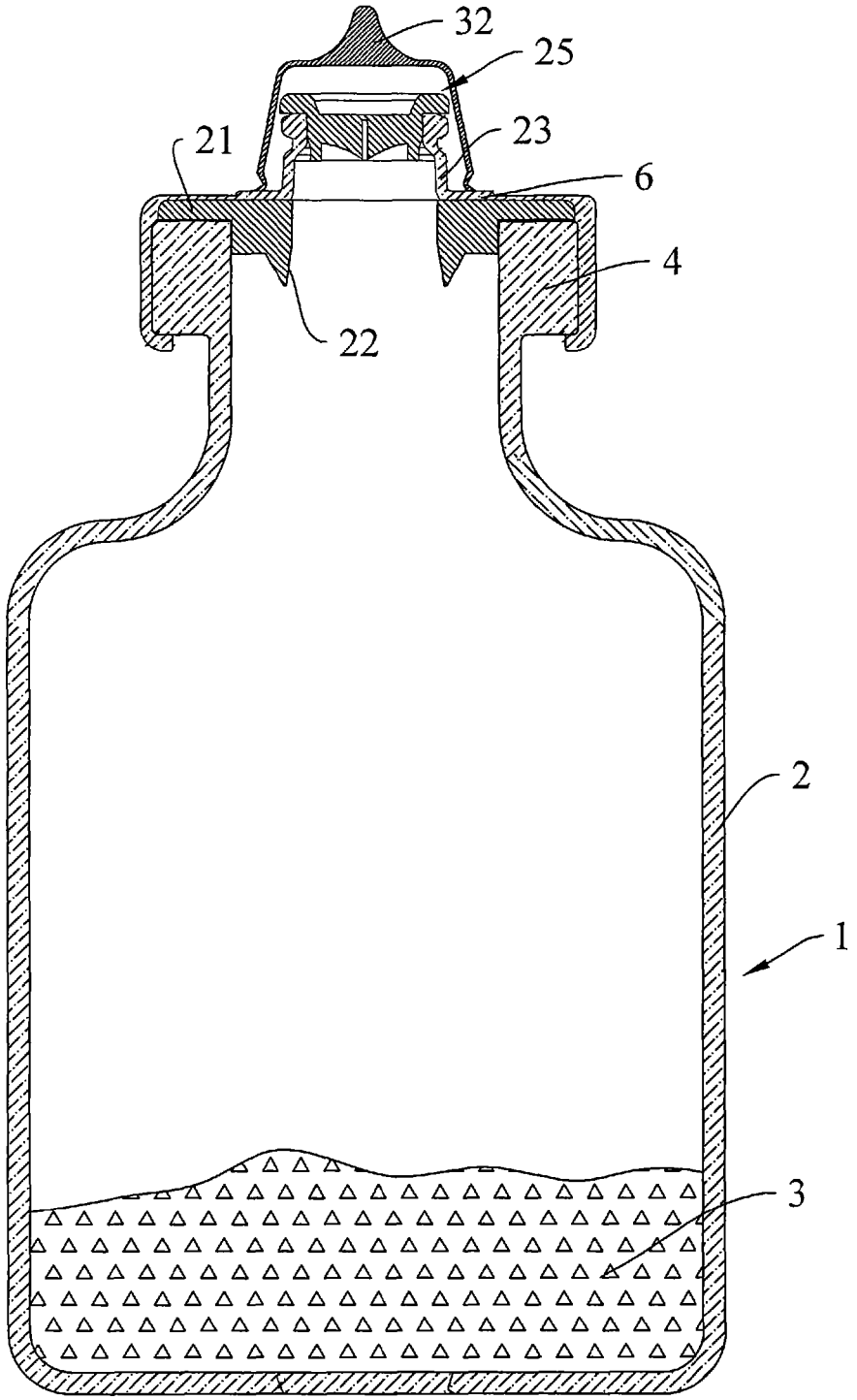
FIG. 9 shows an axial section of a second exemplary bottle according to the invention with hermetic closure and cap pierceable by the luer of a luer-lock syringe.
Figure 10:
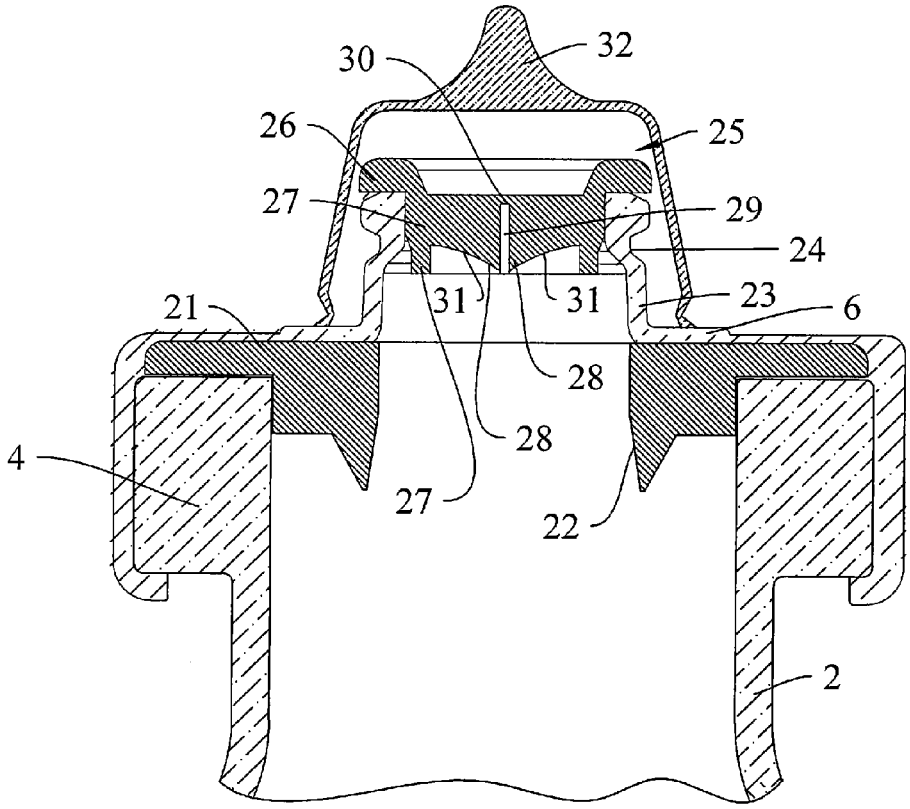
FIG. 10 shows the enlarged detail of the hermetic closure area of the bottle in FIG. 9.
Figure 11:
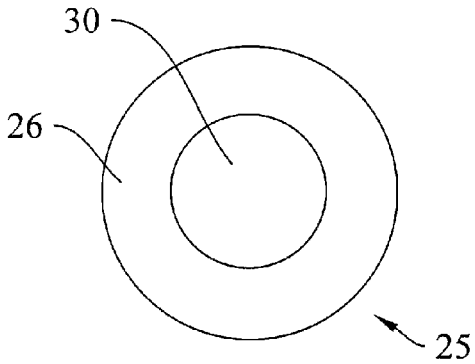
FIG. 11 shows the pierceable closing cap of said bottle seen from the top with respect to FIGS. 9 and 10.
Figure 12:
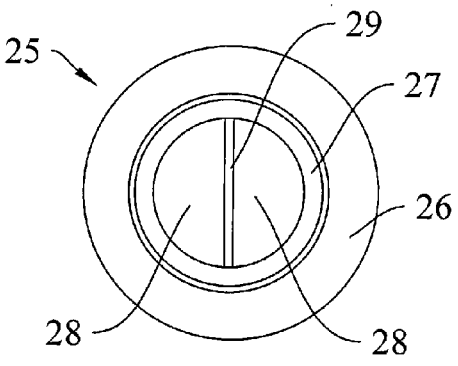
FIG. 12 shows said closing cap seen from the bottom with respect to FIGS. 9 and 10.

A protective cap 32 is above support 23 and closing cap 25, as shown in FIGS. 9 and 10. Easy-to-break attachment points keep cap 32 in place above collar 6.

Figure 13:
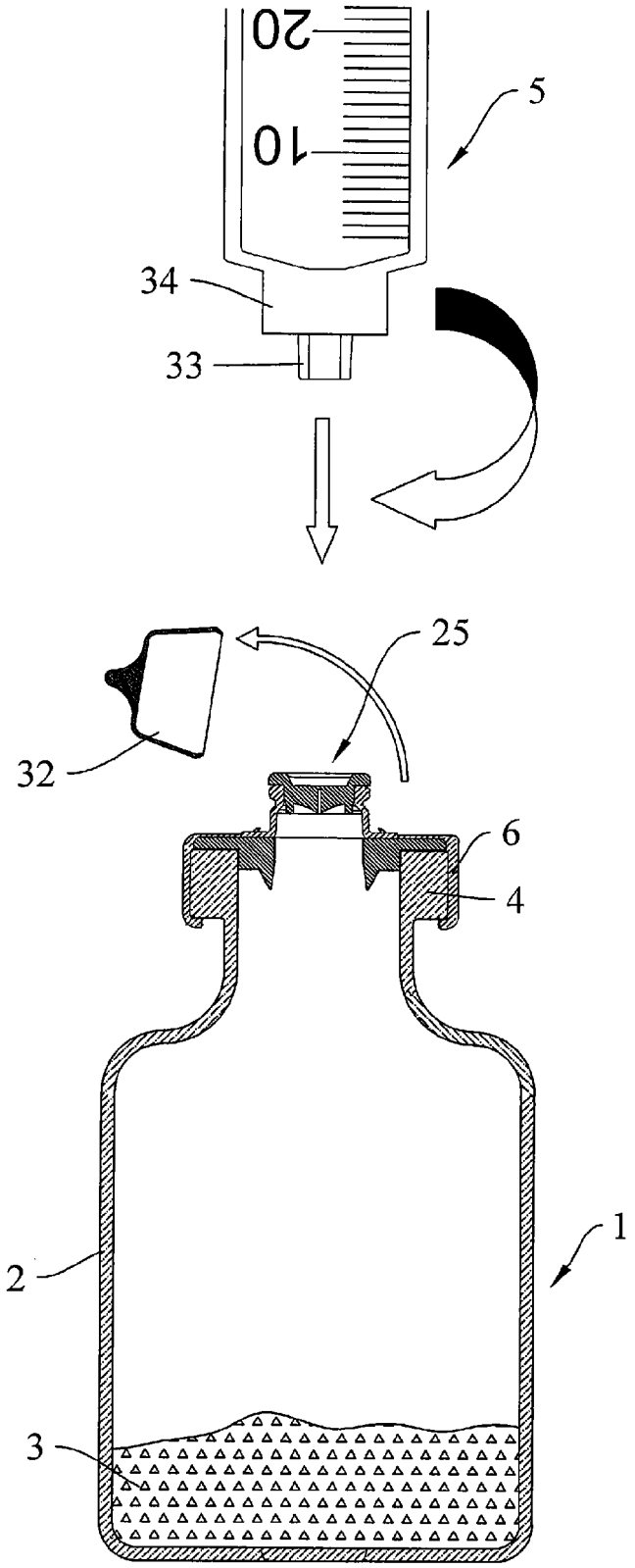
FIG. 13 shows a bottle as shown in FIG. 9 and a luer-lock syringe immediately before being connected together in order to the closing cap of the bottle.

FIG. 13 shows bottle 1 while the protective cap 32 is being removed for receiving the luer or the connection tang of a needle-free syringe.

In this case, the syringe may also be of the type known as "luer-lock", i.e. with male luer 33 partially surrounded by a coaxial outer sleeve 34, internally threaded, as shown in FIG. 13.

Figure 14:
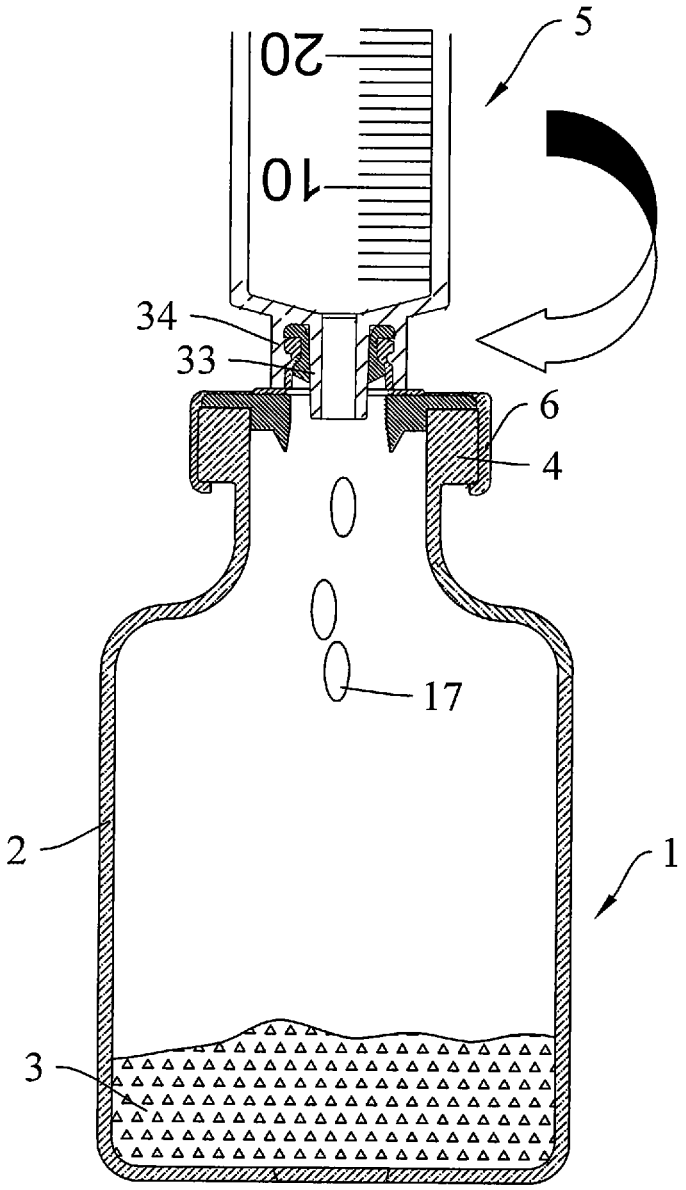
FIG. 14 shows the bottle and the syringe connected together.

The connection is carried out by pressing luer 33 against the top of the closing cap 25 and screwing the outer sleeve 34 of the syringe onto support 23, to this end using the inner threading of sleeve 34 and the outer groove 24 of support 23. Thereby, luer 33 pierces membrane 30 and is inserted into slot 29, thus moving away the two lateral lips 28 up to reach the interior of the bottle body, as shown in FIG. 14.

Since, as already said, the overall axial height of slot 29 and membrane 30 is preferably less than or equal to the length of the syringe luer, luer 33 thus introduced allows the syringe to operate in a bidirectional manner, thus allowing both the introduction of mixing liquid drops 17 for the active substance 3 (FIG. 14) and the drawing of the possibly mixed active substance.

Figure 15:
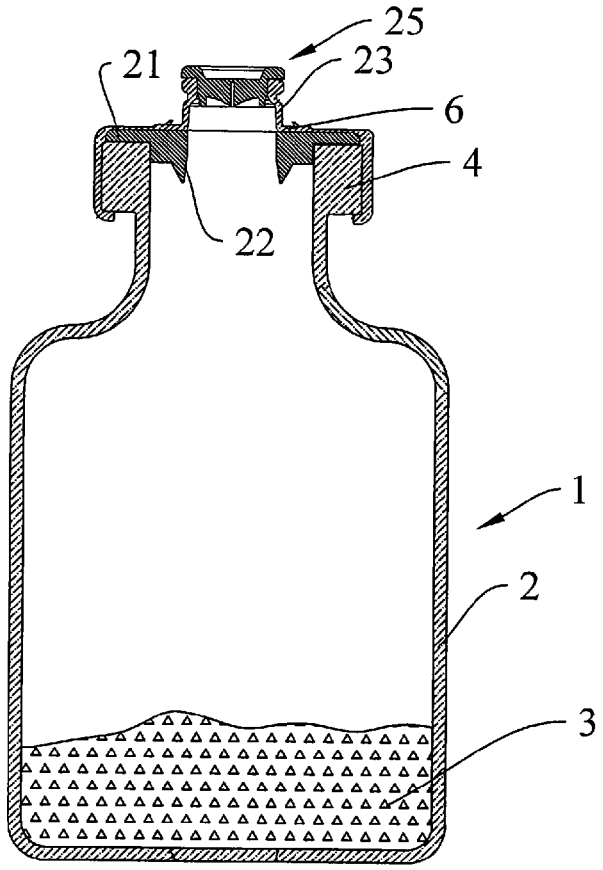
FIG. 15 shows an axial section of the same bottle once the syringe has been disconnected.
Figure 16:
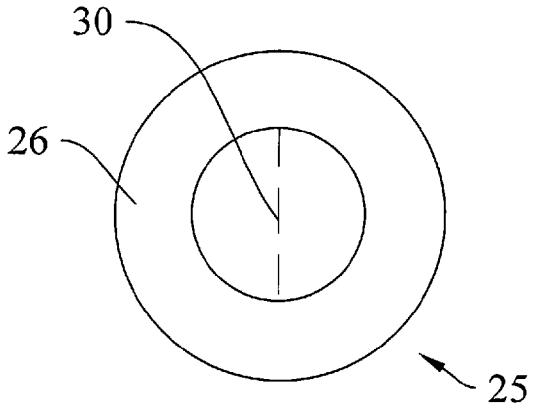
FIG. 16 shows a top plan view of the closing cap of the bottle in FIG. 15.

At the end of the operation, the syringe luer 33 can be extracted from slot 29 of the closing cap 25, the lateral lips 28 of which are closed again by means of elastic stress, thus reaching the position in FIG. 15, which is identical to initial position shown in FIG. 9. Membrane 30 also closes back elastically, thus obtaining the hermetic closure of the bottle again, as shown in FIG. 16, where the dash-and-dot line 35 symbolizes the re-contact and closing point of the membrane.

The concave shape of the outer recesses 31 of the lateral lips 28 facilitates and forces the closing of slot 29 and membrane 30, carrying out a function of check valve which prevents the liquid from leaking out from bottle 1 during and after the extraction of the luer.

The invention claimed is:

1. A bottle for containing pharmacological and/or nutritional active substances, which is hermetically closed by a fixed closing cap which is permanently fastened to the bottle and is pierceable by the pressure exerted on said fixed closing cap by the luer of a needle-free syringe, said closing cap including a check valve with closing lips which can be opened by introducing said luer and can be elastically closed back upon the extraction of the luer introduced, wherein said closing cap is formed by an upper part and a lower part, said lower part forming said closing lips and being crossed by a thin vertical slot having rectangular section which separates said closing lips and is open at the bottom to allow said lips to be opened upon the introduction of said luer, wherein said slot is closed at the top by a membrane which is pierceable and elastically resealable to hermetically close the inlet end of said check valve, wherein said closing lips and said membrane are formed as a single body made of elastically deformable material and said closing lips are externally delimited by concave recesses which laterally extend upwards with increasing depth from the lower end of said lips.

2. The bottle according to claim 1, wherein the sum of the length of said slot and the thickness of said membrane is equal to or less than the length of a syringe luer.

3. The bottle according to claim 2, wherein said membrane has a thickness of about 0.1 mm.

4. The bottle according to claim 1, wherein said single body is made of a thermoplastic elastomeric material.

5. The bottle according to claim 4, wherein said thermoplastic elastomeric material is a styrene-ethylene-butylene-styrene-based compound.

6. The bottle according to claim 1, wherein said single body is made of medical-grade silicon.

7. The bottle according to claim 1, wherein said slot is formed in the step of molding said single piece.

8. The bottle according to claim 1, wherein said single body made of elastically deformable material is sealingly forced into the mouth of the bottle body.

9. The bottle according to claim 1, wherein said single body made of elastically deformable material is engaged in sliding contact into a support placed above and fixed to the mouth of the bottle body.

10. The bottle according to claim 9, wherein said support is provided with an outer groove which is suitable for screwing the outer end sleeve of a luer-lock syringe.

11. The bottle according to claim 1, wherein it comprises a cover or cap for protecting said closing cap prior to the first use of the bottle.

12. A bottle for containing pharmacological and/or nutritional active substances, which is hermetically closed by a fixed closing cap which is fastened to the bottle and is pierceable by the pressure exerted on said fixed closing cap by the luer of a needle-free syringe, said closing cap including a nonreturn valve with closing lips which can be opened by introducing said luer and is elastically closed back upon extraction of the luer introduced, wherein said closing cap is formed by an upper part which laterally rests on a mouth of the bottle and by a lower part, said lower part being sealingly forced into said mouth and forming said closing lips and being crossed by a thin vertical slot having rectangular section which separates said closing lips and is open at the bottom to allow said lips to be opened upon the introduction of said luer, wherein said slot is closed at the top by a membrane which is pierceable by the syringe luer and is elastically resealable to automatically hermetically close an inlet end of said nonreturn valve when the syringe luer is extracted, wherein said closing lips and said membrane are formed as a single body made of elastically deformable material, and wherein said closing lips are externally delimited by concave recesses which laterally extend upwards with continuously increasing depth from a lower end of said lips to a ring structure provided on and protruding from the lower part of the single body and surrounding said lips.

13. The bottle according to claim 12, characterized in that the sum of the length of said slot and the thickness of said membrane is equal to or less than the length of a syringe luer.

14. The bottle according to claim 13, characterized in that said membrane has a thickness of about 0.1 mm.

15. The bottle according to claim 12, characterized in that said single body is made of a thermoplastic elastomeric material.

16. The bottle according to claim 15, characterized in that said thermoplastic elastomeric material is a styrene-ethylene-butylene-styrene-based compound.

17. The bottle according to claim 12, characterized in that said single body is made of medical-grade silicone.

18. The bottle according to claim 12, characterized in that said slot is formed in the step of molding said single piece.

19. The bottle according to claim 12, characterized in that said single body made of elastically deformable material is sealingly forced into the mouth of the bottle body.

20. The bottle according to claim 12, characterized in that said single body made of elastically deformable material is sealingly forced into a mouth of a support placed above and fixed to the mouth of the bottle body.

21. The bottle according to claim 20, characterized in that said support is provided with an outer groove which is suitable for screwing the outer end sleeve of a luer-lock syringe onto the support.

22. The bottle according to claim 12, characterized in that the bottle comprises a cover or cap for protecting said closing cap prior to the first use of the bottle.

* * * * *